United States Patent [19]

Salotto

[11] Patent Number: 4,846,453

[45] Date of Patent: Jul. 11, 1989

[54] KNOCK-DOWN TYPE WORKBENCH

[76] Inventor: Arnold Salotto, 8205 Elberon Ave., Philadelphia, Pa. 19111

[21] Appl. No.: 114,304

[22] Filed: Oct. 27, 1987

[51] Int. Cl.[4] ..... B25B 1/00

[52] U.S. Cl. ..... 269/41; 269/88; 269/289 R; 269/295; 269/901; 144/286 A; 182/151

[58] Field of Search ..... 144/286 R, 286 A; 297/440, 442; 108/157, 153; 182/151; 269/41, 295, 88, 901, 289 R

[56] References Cited

U.S. PATENT DOCUMENTS

| | | | |
|---|---|---|---|
| 1,552,340 | 9/1925 | Paul . | |
| 1,645,336 | 10/1927 | McGlothern . | |
| 3,035,660 | 5/1962 | Leon | 182/151 |
| 4,105,091 | 8/1978 | Mahan | 182/151 |
| 4,154,435 | 5/1979 | Alessio . | |
| 4,155,386 | 5/1979 | Allessio . | |
| 4,182,432 | 1/1980 | Cassitt | 182/151 |
| 4,186,784 | 2/1980 | Stone | 144/286 A |
| 4,433,753 | 2/1984 | Watson | 297/442 |
| 4,558,649 | 12/1985 | Maier et al. . | |
| 4,574,917 | 3/1986 | Stoddard . | |
| 4,740,032 | 4/1988 | Olsen et al. | 297/442 |

*Primary Examiner*—Robert C. Watson
*Attorney, Agent, or Firm*—Benasutti & Murray

[57] ABSTRACT

A knock-down type workbench including a three piece support structure assembly which may be assembled in rigid form entirely without the use of nails, screws or other fastening means. The knock-down workbench includes a plurality of table tops which have different functions and are interchangeable. The panels of the workbench are interlockingly stressed to create a structurally tight workbench held together by forces created by the interlocking parts. Thus, the workbench may be lifted or severely jolted without fear of it collapsing.

18 Claims, 8 Drawing Sheets

KNOCK-DOWN TYPE WORKBENCH

FIELD OF THE INVENTION

The present invention relates to workbenches, and more specifically, to portable knock-down type workbenches.

BACKGROUND OF THE INVENTION

This invention relates to workbenches of the knock-down type with interlocking joints whereby the table may be assembled in rigid form entirely without the use of nails, screws or other fastening means. Most workbenches in todays time, are very complicated and require a multitude of parts or fasteners for assembly.

Some patents directed toward making a workbench compact for storage have taken a folding approach. U.S. Pat. Nos. 4,155,386 issued on May 22, 1979; 4,154,435 issued on May 15, 1979; and 1,552,340 issued on Sept. 1, 1925 all show foldable workbenches. Each device is directed to a foldable, portable workbench having a work table and a support structure for supporting the work table. These devices are complicated and use a multitude of fasteners to assemble the workbench.

The use of knock-down devices has been known in the prior art. U.S. Pat. No. 4,574,917 issued on Mar. 11, 1986, shows a three piece knock-down sawhorse including three interlocking plywood panels, a pair of which function as legs at either end of the remaining panel. The remaining panel functions as the back of the sawhorse.

Another type of interlocking workbench has been suggested in U.S. Pat. No. 4,558,649 issued on Dec. 17, 1985 to Maier et al. This workbench includes a four-legged table having a 5-piece table top wherein the table top is interchangeable with other types of table tops.

U.S. Pat. No. 1,645,336 issued on Oct. 11, 1927 to McGlothern discloses a knock-down type table with locking joints whereby the table may be assembled in rigid form entirely without the use of nails, screws or other fastening means. The invention resides essentially in the joints at all four corners of the table.

SUMMARY OF THE INVENTION

The principal object of the present invention is to provide a table of the knock-down type with interlocking joints whereby the table may be assembled in rigid form entirely without the use of nails, screws or other fastening means.

It is a further object of the present invention to provide a workbench which is easy to manufacture.

It is another object of the present invention to provide a workbench which may be assembled by a single person.

Another object of the present invention is to provide a workbench with easily interchangeable table tops.

Another object of the present invention is to provide a workbench which is collapsible and easily carried as a unit.

Another object of the present invention is to provide a workbench which includes a plurality of holding or gripping features which enable a single person to perform a variety of machining processes.

Another object of the present invention is to provide a non-hinged portable light weight collapsible, knock-down type workbench.

Another object of the present invention is to provide a workbench which can easily accommodate left-handed or right-handed users.

Another object of the present invention is to provide a portable knock-down workbench which can be assembled to provide a work place and a tool rest within a short period of time.

A further object of the present invention is to provide a knock-down workbench including a central support panel having identical opposing lower and upper end sections; a pair of leg panels including lower and upper portions releasably interconnected to the lower and upper end sections respectively; and the central support panel including means for biasing the upper portions towards the upper end sections whereby the leg panels are stressed and substantially parallel when the workbench is assembled.

DESCRIPTION OF THE PREFERRED EMBODIMENT

Figure 1:
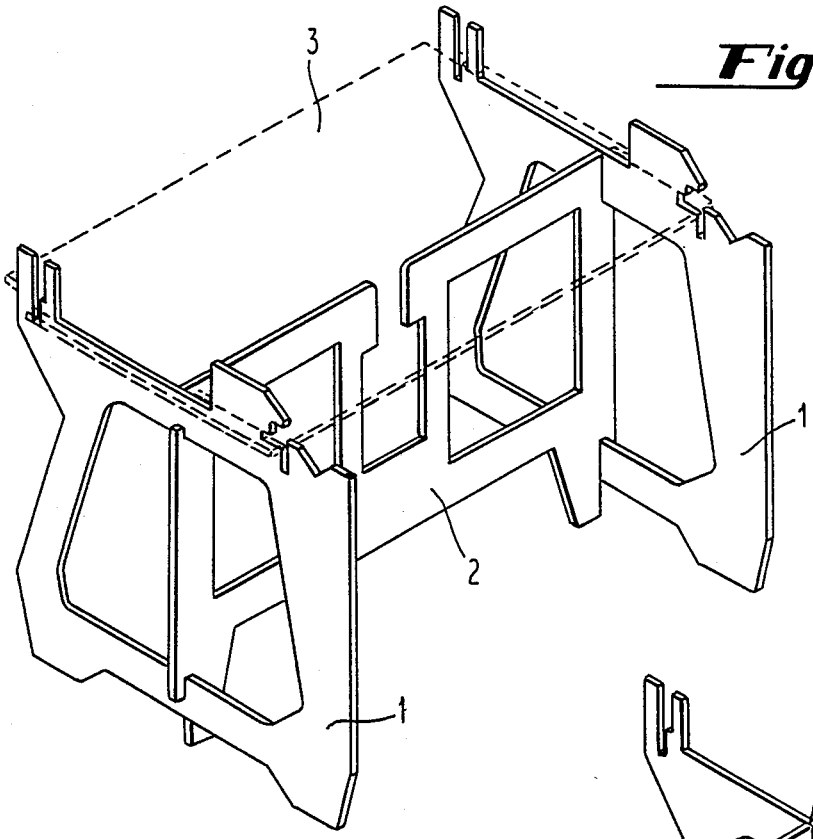
FIG. 1 is a perspective view of the preferred embodiment of the invention showing the assembled workbench with the table top in phantom.

Certain terminology will be used in the following description for convenience only and will not be limiting. The words "right", "left", "lower" and "upper" will designate directions in the drawings to which reference is made. The words "inwardly" and "outwardly" will refer to directions toward and away from, respectively, the geometric center of the device and designated parts thereof. Said terminology will include the words above specifically mentioned, derivatives thereof and words of similar import.

FIG. 1 shows a pair of identical leg panels 1, interlockingly attached to opposite ends of a central support panel 2. In the assembled configuration, the identical leg panels are in parallel. A table top 3 (shown in phantom) is interlocked on the upper portion of the leg panels 1 and is buttressed in the middle by the central support panel 2.

Figure 2:
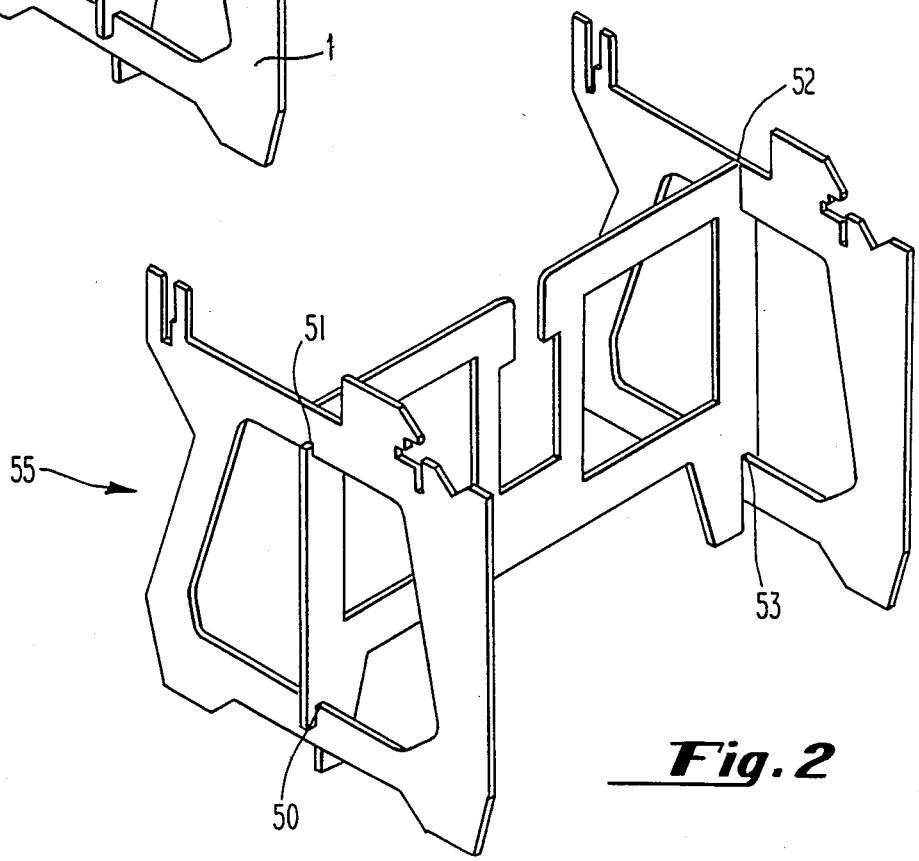
FIG. 2 is a perspective view of the support structure assembly of the preferred embodiment of the invention.

FIG. 2 demonstrates that the workbench support structure assembly 55 is independent of the table top 3. The support structure assembly is held together by four interlocking joints 50, 51, 52 and 53.

Figure 3:
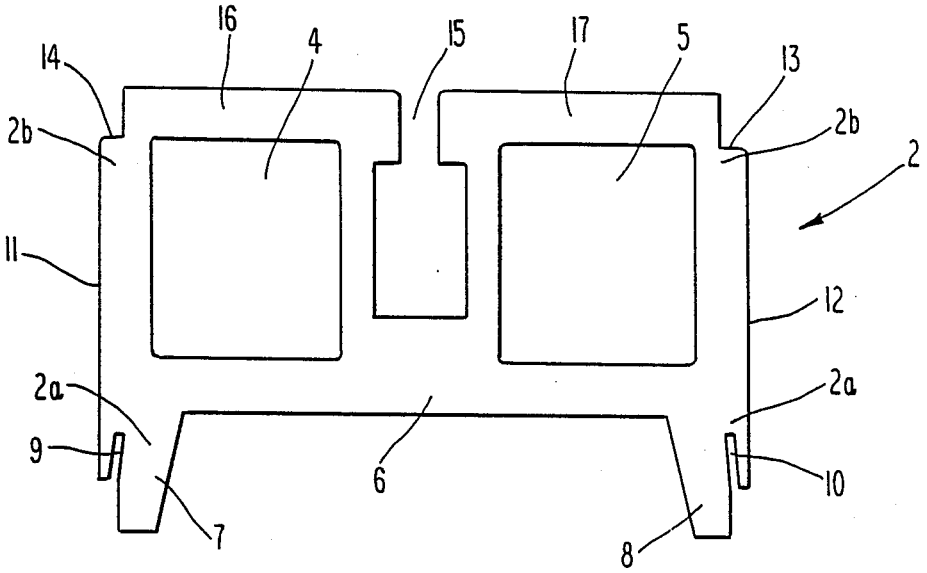
FIG. 3 is an elevation view of the central support panel of the preferred embodiment of the invention.

FIG. 3 shows the central support panel 2 which is preferably constructed from a sheet of thick plywood. The central support panel has identical opposing lower 2*a* and upper 2*b* end sections and includes rectangular cutouts 4 and 5 for reducing the overall weight of the workbench. Central support panel 2 has a main longitudinal section 6 which has interlocking panels 7 and 8 extending downwardly therefrom. The interlocking panels 7 and 8 act as support legs for the workbench and include slots 9 and 10 for receiving leg panels 1. Slots 9 and 10 are each angled inwardly approximately 3° from the outside edges 11 and 12 of the central support panel 2. By angling the slots 9 and 10, the upper portion of the leg panel is inwardly biased. Lands 13 and 14 receive the inwardly biased upper portion of the identical leg panels 1. Cutout 15 allows space for a saw to be actuated during workbench use. The tops 16 and 17 of the support panel is used to buttress the table top at its center.

Figure 4:
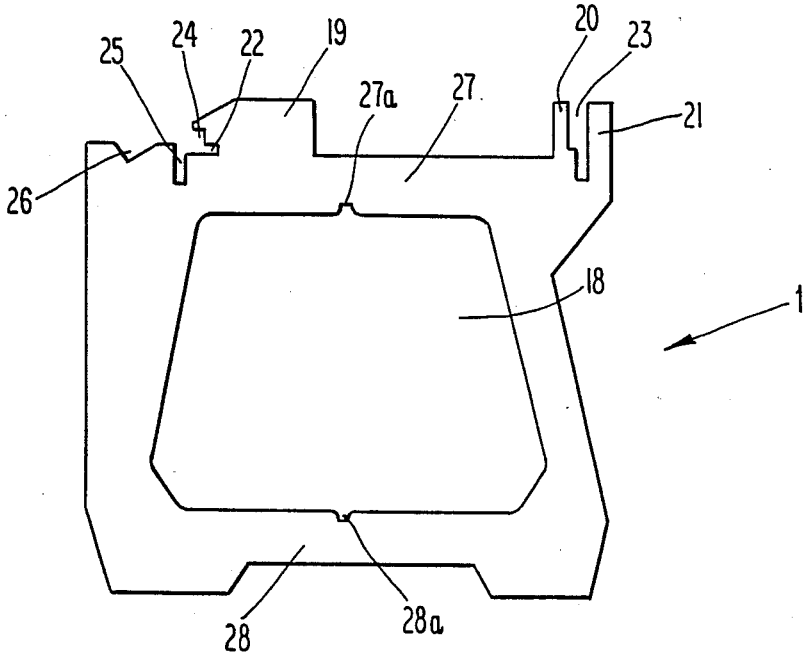
FIG. 4 is an elevation view of one side of one of the two identical leg panels of the preferred embodiment of the invention.

FIG. 4 shows a leg panel 1, also preferably made of a thick plywood, including a cutout 18 for reducing the overall weight of the leg panel and to provide space for the central support panel to interlock therein. Tabs 19, 20 and 21 and slot 22 interlock with the table top to secure the table top on the workbench. Slots 23, 24, 25 and 26 are used for securing or holding a work piece during a machining process. The upper portion 27 includes a notch 27*a* which interlocks with lands 13 or 14 of the central support panel 2. The lower portion 28 includes a notch 28*a* which interlocks with slot 9 or 10 of the central support panel, for interlocking the workbench as an assembled unit.

Figure 5:
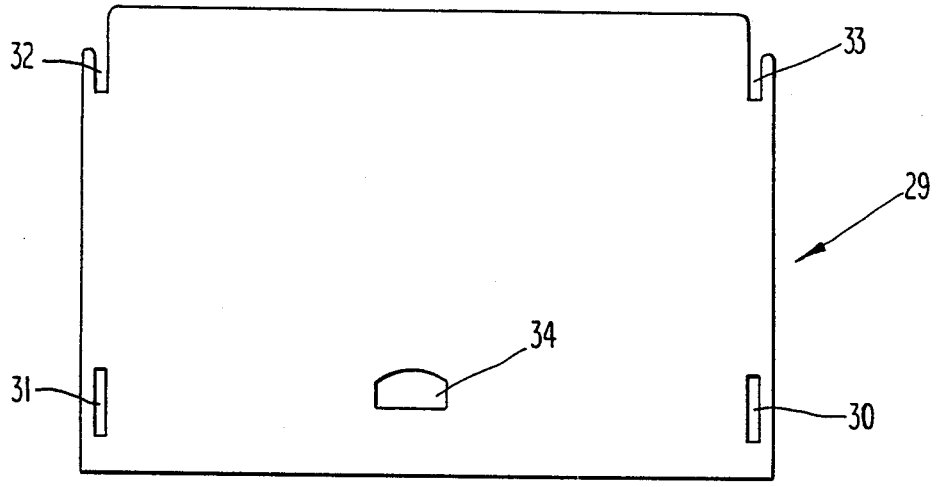
FIG. 5 is an elevation view of the standard basic table top of the preferred embodiment of the invention.

FIG. 5 shows a basic table top 29, also preferably made of thick plywood. Slots 30, 31, 32 and 33 interlock with tabs 19, 20 and 21 and slot 22 of the leg panel 1 for securing the table top 29 to the support structure assembly 55. Cutout 34 provides a handle for carrying the table top.

Figure 6:
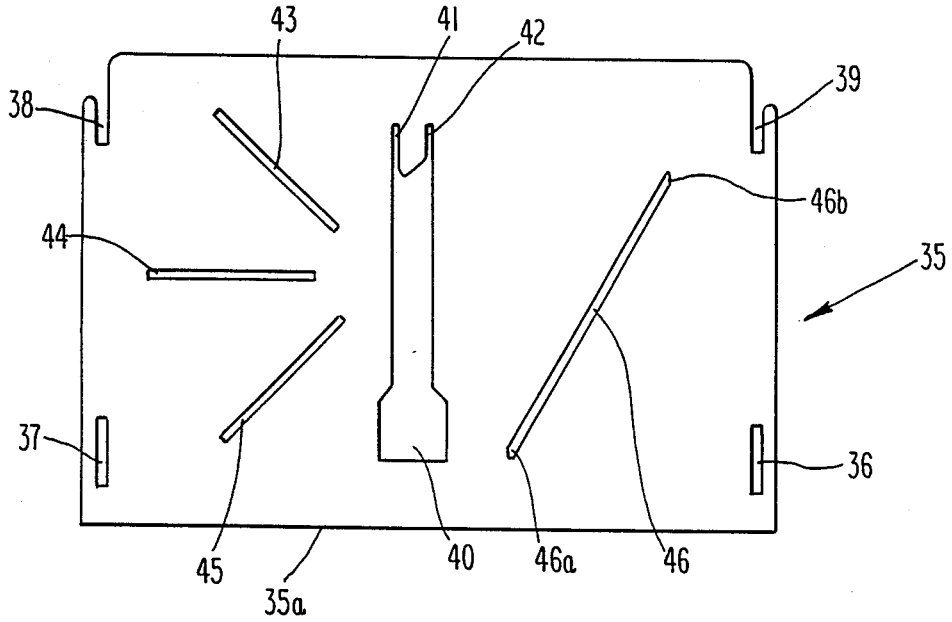
FIG. 6 is an elevation view of the carpenter's table top of the preferred embodiment of the invention.

FIG. 6 shows an alternate carpenter's table top 35, also preferably made of thick plywood. Slots 36, 37, 38 and 39 interlock with tabs 19, 20 and 21 and slot 22 of the leg panel 1 for securing the table top to the support structure assembly 55. Cutout 40, in the middle of the table top 35, allows room for sawing or other activities which require a tool to reciprocate below the plane of the table top 35 and provides a handle for carrying the table top 35. Slots 41 and 42 are used as saw rests for holding a saw when it is not in use. Cutouts 43, 44 and 45 are used to hold the meter guide, described below. Cutout 46 is a cam slot for guiding the vice grip block, described below. Alternatively, additional cam slots may be added to provide plural simultaneous vice grip features (not shown).

FIGS. 7–12 are directed to an alternate embodiment. Accordingly, similar element numerals indicate similar elements as in the preferred embodiment. For example, element number 29 indicates the basic table top of the preferred embodiment, while element number 129 indicates the basic table top of the alternate embodiment.

Figure 7:
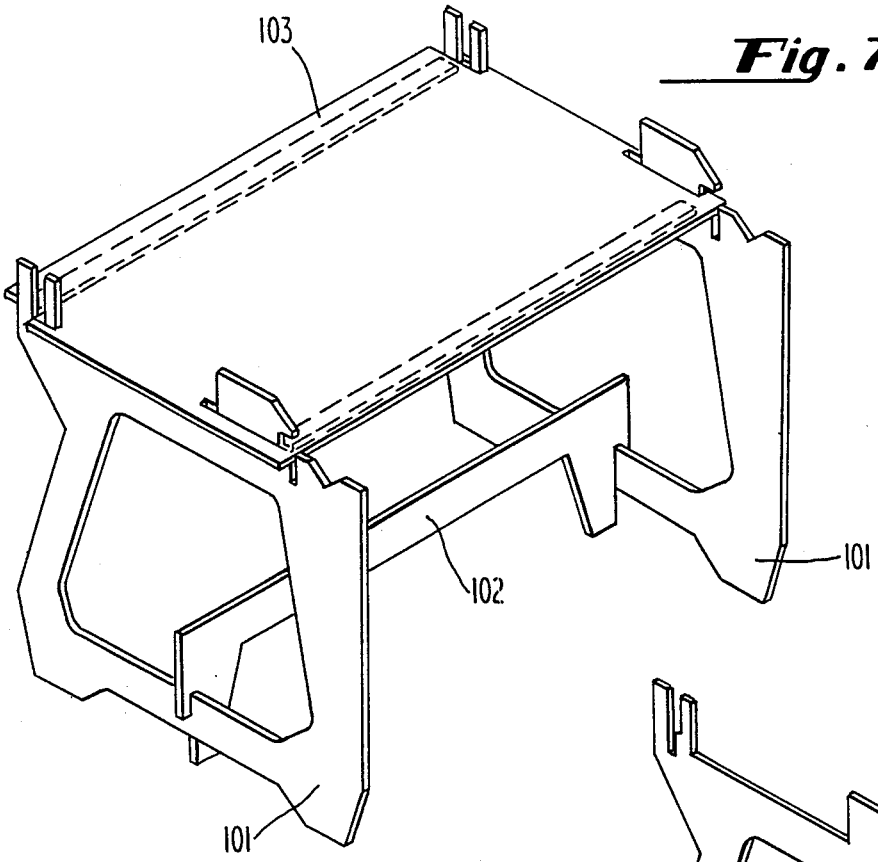
FIG. 7 is a perspective view of an alternate embodiment of the invention of the assembled workbench.

FIG. 7 shows an alternate embodiment of the assembled work bench. This workbench is comprised of a pair of identical leg panels 101. The leg panels 101 are interlockingly attached to identical opposite ends of a central support panel 102. The upper portion of the leg panels 101 are interlockingly attached to a table top 103.

Figure 8:
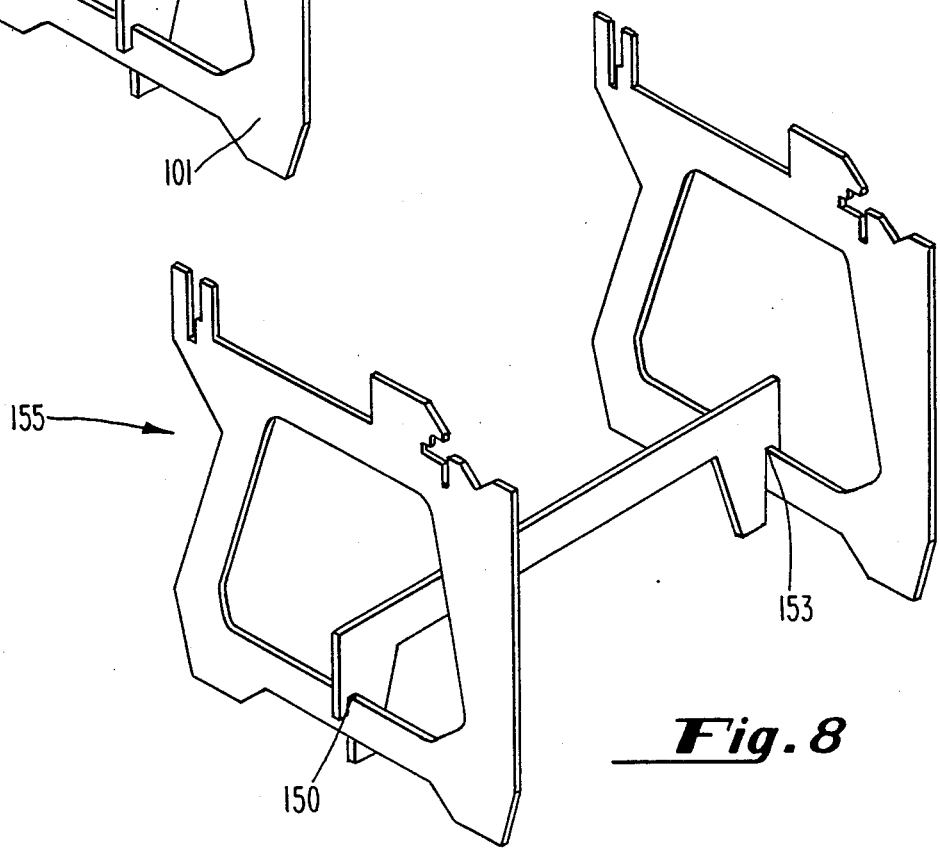
FIG. 8 is a perspective view of the support structure assembly of an alternate embodiment of the invention.

FIG. 8 shows the alternate embodiment's support structure assembly 155. The support structure assembly is held together at the lower end by two interlocking joints 150 and 153. Unlike the preferred embodiment, there is no extra support at the upper end of the leg panels 101.

Figure 9:
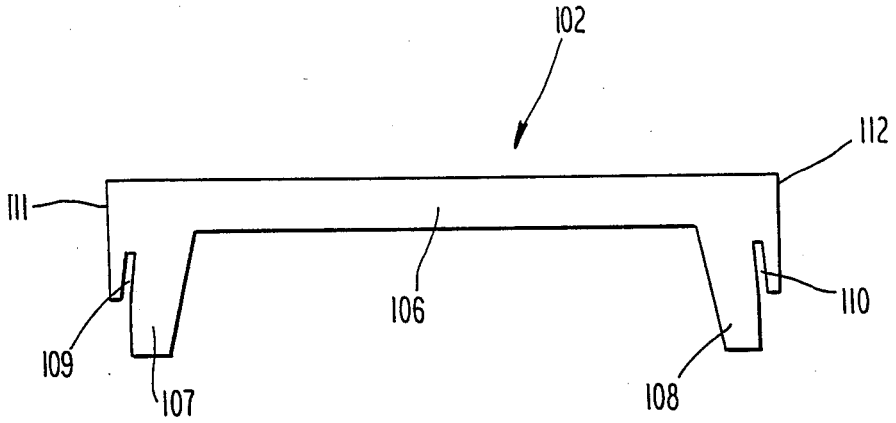
FIG. 9 is an elevation view of the central support panel of an alternate embodiment of the invention.

FIG. 9 shows the alternate embodiment's central support panel 102 which is preferably constructed from a sheet of thick plywood. The central support panel 102 has a main longitudinal section 106 which has interlocking panels 107 and 108 extending downwardly therefrom. The interlocking panels 107 and 108 act as support legs for the workbench and include slots 109 and 110 for receiving the leg panel 101. Slots 109 and 110 each are angled inwardly approximately 3° from the outside edges 111 and 112 of the central support panel 102. By angling the slots 109 and 110 the upper end of the leg panel is inwardly biased for compressively gripping the table top.

Figure 10:
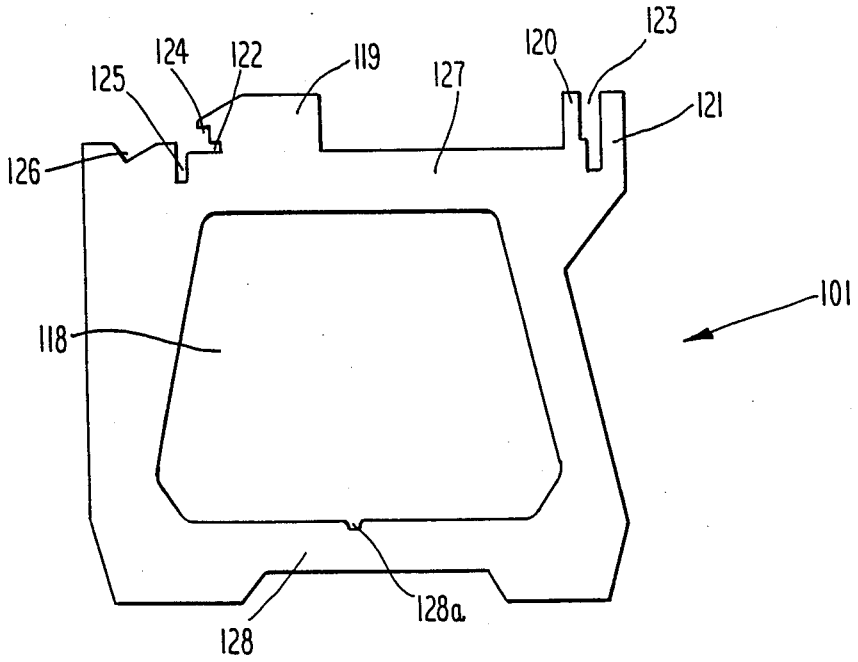
FIG. 10 is an elevation view of one side of the two identical leg panels of an alternate embodiment of the invention.

FIG. 10 shows one side of the two identical leg panels of the alternate embodiment. The leg panel 101, preferably made of thick plywood, includes a cutout 118 for reducing the overall weight of the leg panel and to provide space for the central support panel to interlock therein. The upper portion 127 includes tabs 119, 120 and 121 and a slot 122, which interlock with the table top for securing the table top on the workbench. Slots 123, 124, 125 and 126 are used for securing or holding a work piece during a machining process. The lower portion 128 includes a notch 128*a* which receives slot 109 or 110 of the central support panel, for interlocking the workbench as an assembled unit.

Figure 11:
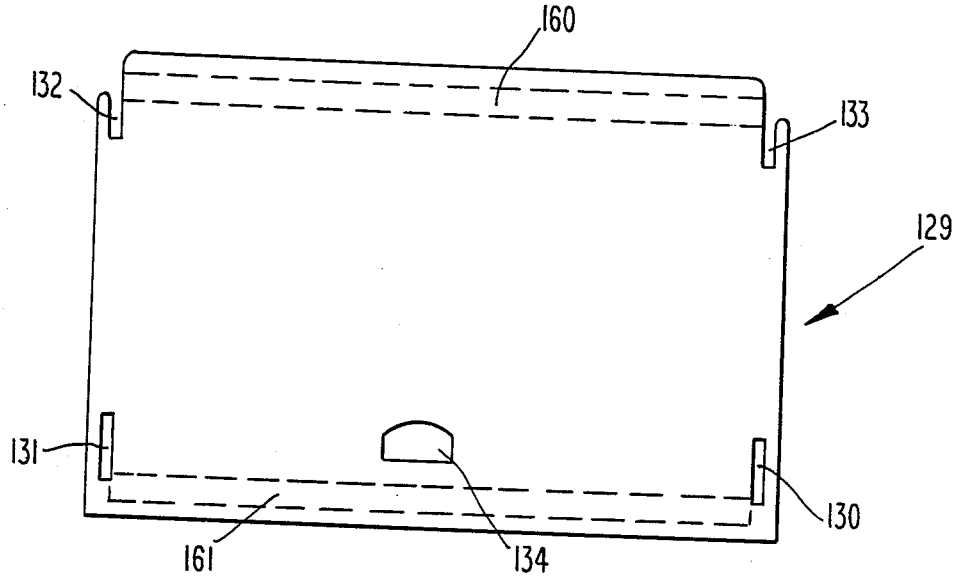
FIG. 11 is an elevation view of the standard basic table top of an alternate embodiment of the invention.

FIG. 11 shows a basic table top 129, also preferably made of thick plywood. Slots 130, 131, 132 and 133 interlock with the tabs 119, 120 and 121 and slot 122 of the leg panels 101, for securing the basic table top 129 to the support structure assembly 155. Cutout 134 provides a handle for carrying the basic table top 129. Support ribs 160 and 161 are located below and extend the length of the basic table top between the leg panels 101, for providing an extra element of rigidity to the table top 129.

Figure 12:
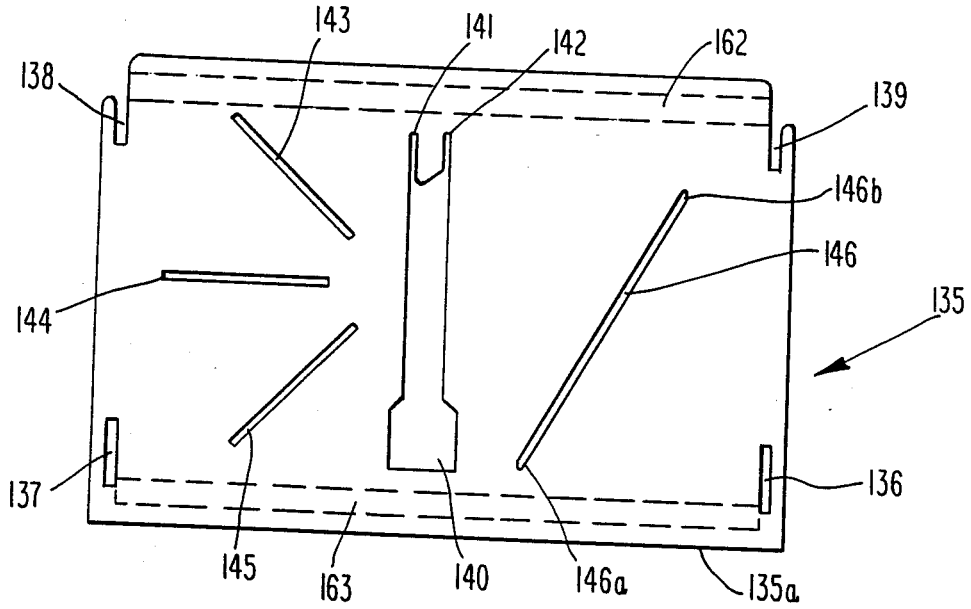
FIG. 12 is an elevation view of the carpenter's table top of an alternate embodiment of the invention.

FIG. 12 shows an alternate embodiment of the basic table top 129, a carpenter's table top 135 also preferably made of thick plywood. Slots 136, 137, 138 and 139 interlock with tabs 119, 120 and 121 and slot 122 of the leg panels 101 for securing the table top 135 to the support structure assembly 155. Cutout 140, in the middle of the table top 135, allows room for sawing or other activities which require a tool to reciprocate below the plane of the table top 135 and provides a handle for carrying the table top 135. Slots 141 and 142 are used as saw rests, for holding a saw when it is not in use. Cutouts 143, 144 and 145 are used to hold the miter guide, described below. Cutout 146 is a cam slot for guiding the vice grip block, described below. Alternatively, additional cam slots may be added to provide plural simultaneous vice grip features (not shown). Support ribs 162 and 163 are located below and extend the length of the table top, between the leg panels 101, for providing an extra element of rigidity to the table top 129.

Figure 13:
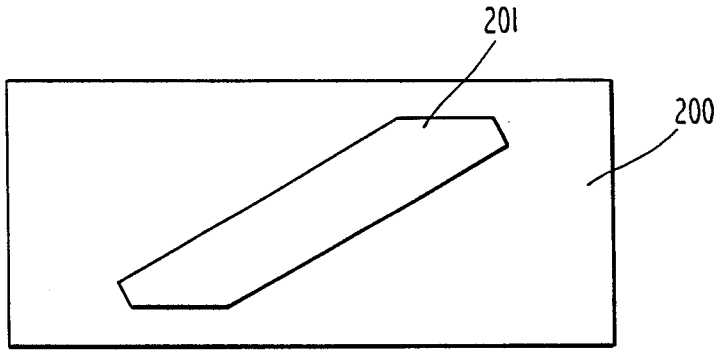
FIG. 13 is a bottom view of the vice grip block.
Figure 14:
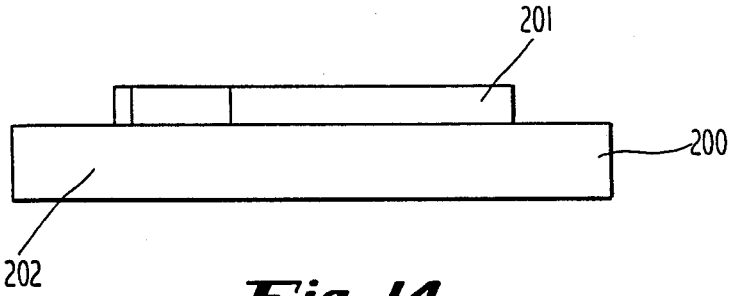
FIG. 14 is a front view of FIG. 13.

FIGS. 13 and 14 show the vice grip block 200 and the cam follower 201. The cam follower 201 slidingly engages the cam slot 46 or 146 of the carpenter's table top 35 or 135, respectively. The front surface 202 of the vice grip block is knurled or roughened (not shown) for providing better gripping characteristics.

Figure 15:
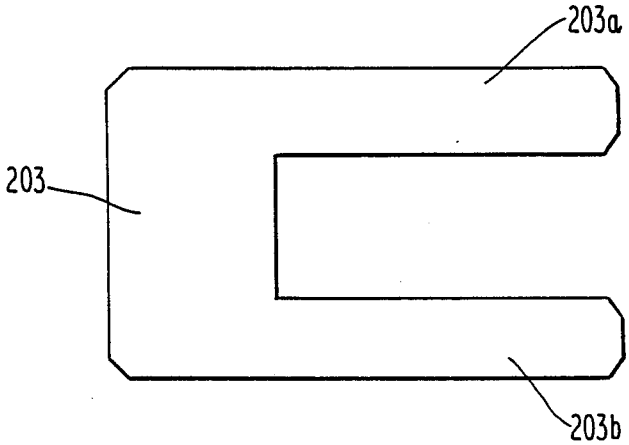
FIG. 15 is an elevation view of a standard U-clamp.

FIG. 15 shows a standard U-clamp 203 for securing a work piece to the workbench or miter guide. The legs 203*a* and 203*b* of the U-clamp may include a handle depending outwardly therefrom.

Figure 16:
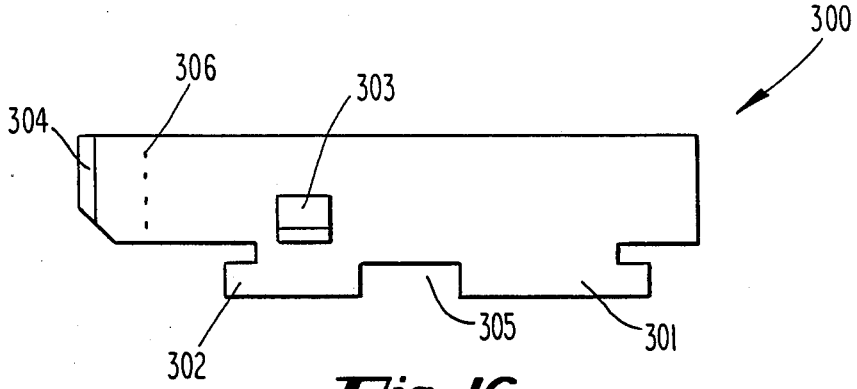
FIG. 16 is an elevation view of the meter guide.
Figure 17:
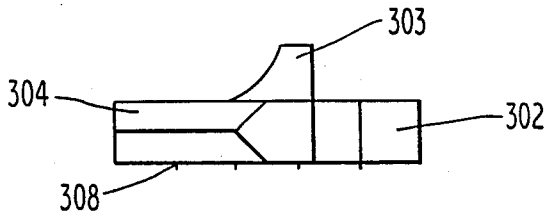
FIG. 17 is a left side view of FIG. 16.
Figure 18:
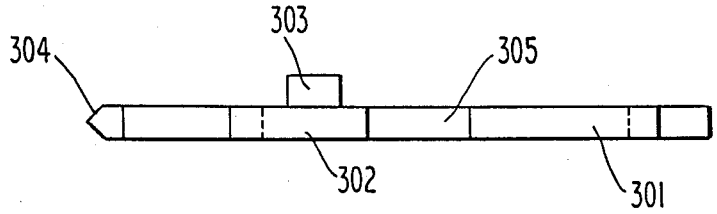
FIG. 18 is a front view of FIG. 16.

FIGS. 16, 17 and 18 show a miter guide 300. Tabs 301 and 302 interlock with miter guide slots 43, 44, 45, 143, 144 or 145 for supporting the miter guide in a vertical position on the table top. Support member 303 sits flat on the table top, for adding structural support to the miter guide when it is installed in the above guide slots. Chamfer 304 provides a guide for the saw, when the miter guide is in use. The slot 305 allows the miter guide to be installed in slot 45, without interference from the top 16 of the central support panel 2. A series of nails 306 embedded in the miter guide 300 extend just beyond the surface 308. These nails 306 are used to help grip the work piece during the machining process. Alternatively, the surface 308 can be knurled or roughened (not shown) for providing better gripping characteristics.

The workbench is assembled by engaging the notch 28*a*, on the lower portion 28 of the leg panel 1, into the slots 9 and 10. Because of the slight inward angle of slots 9 and 10, the notch 27*a*, on the upper portion 27 of the leg panels 1, will be inwardly biased over the lands 13 and 14. This allows a single person to assemble the workbench without the help of others. For instance, after the assembler securely interlocks the first leg panel, he can securely interlock the second leg panel without having to physically hold the first leg panel in place. This stressing of the leg panels 1 creates a structurally tight workbench held together by friction and cantilever forces between the interlocking parts. Thus, the workbench may be lifted or severely jolted without fear of it collapsing. Once the structural support assembly has been interlocked the table top 35 may be fitted over the tabs 19, 20 and 21. With the table top resting on the structural support assembly a rearward thrust or force will interlock the table top into slot 22. Thus, fixedly securing the table top to the support structure assembly.

The type of table top selected is left to the user. In other words, the user may select the basic table top for doing hobby type works such as building models, painting, or sculpting. Once the user is done with the basic table top, he may lift it off and replace it with the carpenter's table top. The carpenter's table top enables ease of woodworking or other craft type work. The slot system of the carpenter's table top is symmetrical. Accordingly, it can be overturned to place the miter guide slots on the right and the cam slot on the left. Thus, the workbench accommodates left-handed and right-handed users by simply overturning the table top.

The alternate embodiment of the workbench is assembled by engaging the center support panel slots 109 and 110 with lower portion leg panel notches 128*a*. Because of the slight inward angle of slots 109 and 110, the leg panels are stressed inwardly at their upper ends. While this embodiment has no extra support at the upper end of the leg panels 101, like the preferred embodiment, it will stand on its own without extra support. This allows a single person to assemble the workbench without the help of others. For instance, after the assembler securely interlocks the first leg panel, he can securely interlock the second leg panel without having to physically hold the first leg panel. When the table top is interlocked with the tabs 119, 120 and 121 and slot 122, the workbench is held together by forces created by the interlocking parts. Thus, the workbench may be lifted or severely jolted without fear of it collapsing. The table top of the preferred embodiment is buttressed at its center by the top 16 and 17 of the central support panel 2. In contrast, the alternate embodiment uses support ribs 162 and 163, which are located below and extend the length of the table top between the leg panels. This provides an extra element of rigidity to the table top. As described above, the table top is interchangeable so that the user may select either the basic table top or the carpenter's table top.

Once the workbench is assembled, the user has a variety of features to work with. For instance, if the user has carpentry work to do, he could interlock the carpenter's table top in place. The carpenter's table top has many features. For instance, a board could be placed across the length of the back of the workbench through slots 23. This provides a backstop for the carpenter to work against. Another feature, includes a container board placed in slots 23 and across the back of the workbench. The container board has a plurality of containers which can hold nails, screws, glue, and other carpentry like tools.

The workbench has many work piece holding features. The holding features allow the user to perform a plurality of processes on the work piece; for instance, sawing, planing, drilling and nailing. For example, slots 23, 24 and 25 all are capable of compressively holding a work piece whose dimensions are akin to the slot size. That is, if a work piece is roughly the same size as the slot, the work piece can be wedged into the slot and compressively held there. The dimensional characteristics of the slots 23, 24 and 25 could be varied to accommodate different size work pieces without departing from the scope of the invention.

If the user had a work piece which did not compressively fit in any of the slots, he could use the vice grip block 200 for securing the work piece in place. The vice grip block 200 is placed on top of the table top 35, with the cam follower 201 slidably engaging the cam slot 46. Due to the positioning of the cam follower 201 on the vice grip block 200 and the angle of the cam slot 46, as the vice grip block reciprocates in the cam slot 46, its rectangular perimeter will remain parallel with the rectangular perimeter of the table top 35. To grip a work piece the user places the vice grip block 200 in the cam slot 46 at position 46*a*. Note FIG. 6. The work piece is positioned between the vice grip block 200 and the tabs 19, 20 and 21 protruding through slots 36 and 39. The user then pushes the vice grip block 200 towards position 46*b* until the work piece is compressively engaged between tabs 19, 20 and 21 and the vice grip block 200. Once the work piece has been compressed to a hand-tight degree, a hammer could be tapped on the edge of the vice grip block to fixedly secure the work piece in place. This process is equally applicable to a larger work piece, which would be placed on the opposite side of slot 46. The only difference being that the vice grip block would slide from position 46*b* to 46*a*, to grip the work piece. This gripping apparatus will allow the user to perform many processes on the work piece, as discussed above.

Another gripping feature of the workbench is the U-clamp 203. The U-clamp can fixedly secure any part of the workbench to a work piece, where the work piece and workbench are of the correct dimensions for that particular U-clamp. The clamp 203 compressively grips a work piece to the workbench. For instance, the work piece could be placed on the table top 35 of the workbench, at the front edge 35*a*, where one leg 203*a* of the U-clamp will slide over the work piece and the other leg 203*b* will slide under the table top 35, thus, compressively clamping the work piece to the workbench. Thus, while the U-clamp 203 holds the end of the work piece being sawed off, a single right-handed user can hold the other end of the work piece down with his left hand, while sawing with his right hand. This prevents the possibility of splintering the work piece, without the use of a second person. This method could be applied to other areas of the workbench. Such as, tabs 19, 20 or 21 and slots 40, 43, 44, 45 and 46. Naturally, different size work pieces will require different U-clamps of corresponding size.

The workbench also has many sawing or cutting features. For example, a work piece placed on top of the table 35 across the slot 40, can be hand-cut by reciprocating a saw back and forth through slot 40. If the user needed to rest or wanted to take a break, he does not have to lift the saw totally out of the slot 40, he can place the saw in holding slots 41 or 42. Slot 40 is not limited to hand saws only, power tools may also be used. Sawing is not limited to the slot 40, if the user had a long work piece he could place it across slots 26 and saw outside the perimeter of the workbench. This feature also applies to slots 23, 24 and 25.

The miter guide provides means for guiding a saw at the proper angle in making a miter joint. By placing the miter guide in any of the slots 43, 44 or 45 a work piece can be held against the miter guide and then sawed. To install the miter guide, tabs 303 and 302 are interlocked in any of the slots 43, 44 or 45 with the chamfer end 304 being placed in the center of the table top 35. If the miter guide is placed, for instance, in slot 43, a work piece could be placed against it and clamped there via the U-clamp 203 or held there by hand with the help of the nails 306. The blade of the saw is then placed against the chamfer end, as a guide, and actuated to yield a true forty-five degree cut. Since only the saw blade is placed against the chamfer end, the teeth of the saw will not wear down the chamfer or guide surface. The miter guide can be placed in slots 44 or 45, to obtain the same results, only at different angles.

If the user preferred not to work on a flat or vertical surface, he could rest the work piece on slots 26 where it would be held at an angle. In this position the user could scallop or chamfer the work piece.

If the user preferred to use the workbench as a general table, for instance in assembling models or sculpting, he could exchange the carpenter's table top 35 for the basic table top 29. The basic table top 29 does not have a plurality of slots therein and therefore would not allow items to fall through to the floor. The basic table top 29 could also use a backstop or container board placed in slots 23, as in the carpenter's table top 35 configuration. In addition, plastic or injection molded craft tops can sit or be interlocked on the basic table top. The craft tops may include a series of troughs for storing supplies and tools. Furthermore, all the slot holding facilities in the carpenter's table top 35, that is slots 23, 22, 25 and 26, are all equally adaptable for holding work pieces in the hobby table top configuration.

The workbench could also be used to hang freshly painted work pieces for air drying. A bar or rod can be placed across slots 26 and the work pieces could be hung therefrom.

Another benefit of the workbench is its ability to be stored in a compact area plus it portable characteristics. When the table is disassembled all the pieces can be laid horizontally on top of each other. This provides an aperture, which functions as a handle, through the top of all the pieces, which enables the user to carry the main components with ease. In addition, a handle grip may be secured to the aperture for allowing the user to carry the disassembled workbench. Thus, the user can easily carry the work-bench to his job site, where it can be quickly assembled.

While the preferred embodiment of the invention has been described, other embodiments may be devised and modifications may be made thereto without departing from the spirit of the invention and the scope of the appended claims. For example, panels made of fiber-reenforced plastic material may be substituted for plywood panels. In addition, other table tops could be used, for instance a gardener's potting table top could include a plurality of circular cutouts for holding plant pots. It is also within the scope of the invention to have a plastic or injection molded table top with depressions or cutouts for holding supplies or tools.

What I claim is:

1. A knock-down workbench comprising:

a central support panel including a first lower end section, a second lower end section, a first upper end section and a second upper end section;

a first leg panel including a first lower portion and a first upper portion each being releasably interlocked to said first lower end section and said first upper end section, respectively;

a second leg panel including a second lower portion and a second upper portion each being releasably interlocked to said second lower end section and said second upper end section, respectively;

a first table top supported by said central support panel and said leg panels;

said central support panel including means for biasing said first and second upper portions towards said first and second upper end sections, respectively; and said central support panel further including stressing means operatively associated with said biasing means for placing said leg panels in a stressed condition when said workbench is assembled.

2. The knock-down workbench of claim 1 wherein said biasing means includes an inwardly angled slot located on each said first and second lower end sections which interlock with said first and second lower portions, respectively, and said stressing means includes a land located on each said first and second upper end sections positioned in a non-linear relationship with the angle of each said inwardly angles slot which interlock with said first and second upper portions, respectively.

3. The knock-down workbench of claim 1 wherein said first table top interlocks with said first and second upper portions of said leg panels and is directly buttressed by said central support panel.

4. The knock-down workbench of claim 3 further including a second table top which interlocks with said first and second upper portions of said leg panels and is directly buttressed by said central support panel whereby said first and second table tops are interchangeable and provide different functions.

5. The knock-down workbench of claim 3 wherein said first table top includes at least one slidable cam-type vice grip means for fixedly securing a work piece.

6. The knock-down workbench of claim 3 wherein said first table top includes a miter means for guiding a saw at the proper angle in making a miter joint.

7. The knock-down workbench of claim 3 wherein said first table top and said central support panel include cooperating cutouts for allowing sawing on said table top.

8. The knock-down workbench of claim 3 wherein said leg panels and said first table top include at least one slot for compressively gripping a work piece.

9. The knock-down workbench of claim 7 wherein said first table top cutout includes slot means for releaseably holding a saw.

10. The knock-down workbench comprising:

a central support panels including identical opposing end sections;

a pair of leg panels including a lower portion releasably interlocked to said central support panel end sections;

said pair of leg panels including an upper portion releasably interconnected to a first table top;

said central support panel including biasing means for biasing said upper portions of said upper leg panels toward each; and said first table top including stressing means operatively associated with said biasing means for placing said leg panels in stressed condition when said workbench is assembled.

11. The knock-down workbench of claim 10 wherein said biasing means includes an inwardly angled slot located on each said end sections which interlock with said lower portion of said leg panel and said stressing means includes slots located on said first table top for receiving said upper portions of said leg panels and positioned in a non-linear relationship with the angle of said inwardly angled slots.

12. The knock-down workbench of claim 11 further including a second table top which interlocks with said upper portion of said leg panels, whereby said first and second table tops are interchangeable and provide different functions.

13. The knock-down workbench of claim 10 wherein said first table top includes at least one slidable cam-type vice grip means for fixedly securing a work piece.

14. The knock-down workbench of claim 10 wherein said first table top includes a miter means for guiding a saw at the proper angle in making a miter joint.

15. The knock-down workbench of claim 10 wherein said first table top includes a cutout for allowing sawing on said table top.

16. The knock-down workbench of claim 15 wherein said first table top cutout includes slot means for releasably holding a saw.

17. The knock-down workbench of claim 10 wherein said leg panels and said first table top include at least one slot for compressively gripping a work piece.

18. The knock-down workbench comprising:

a central supporting panel including a first lower end section, a second lower end section, a first upper end section and a second upper end section;

said lower end sections including an inwardly angled slot and said upper end sections including a land;

a pair of leg panels including a lower portion having a notch interlockingly connected to said inwardly angled slot and an upper portion having a notch biasedly connected to said land;

said upper portion of said leg panels further including a plurality of tabs and a slot; and a table top including a plurality of slots interlockingly connected with said plurality of tabs and said slot, whereby said leg panels are stressed when said work bench is assembled.

* * * * *